US011933136B2

(12) United States Patent
Ramasamy et al.

(10) Patent No.: US 11,933,136 B2
(45) Date of Patent: Mar. 19, 2024

(54) DISSOLVABLE BALLS FOR ACTIVATION AND DEACTIVATION OF A CIRCULATING SUB APPARATUS

(71) Applicant: Saudi Arabian Oil Company, Dhahran (SA)

(72) Inventors: Jothibasu Ramasamy, Dhahran (SA); Chinthaka Pasan Gooneratne, Dhahran (SA); Jianhui Xu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 43 days.

(21) Appl. No.: 17/539,609

(22) Filed: Dec. 1, 2021

(65) Prior Publication Data

US 2023/0167710 A1 Jun. 1, 2023

(51) Int. Cl.

| | |
|---|---|
| ***E21B 34/10*** | (2006.01) |
| ***E21B 21/10*** | (2006.01) |
| ***E21B 34/06*** | (2006.01) |

(52) U.S. Cl.

CPC ..... *E21B 34/063* (2013.01); *E21B 21/103* (2013.01); *E21B 34/10* (2013.01); *E21B 2200/06* (2020.05)

(58) Field of Classification Search

CPC .... E21B 34/063; E21B 34/10; E21B 2200/06; E21B 33/00

See application file for complete search history.

(56) References Cited

U.S. PATENT DOCUMENTS

| | | | | |
|---|---|---|---|---|
| 7,647,964 | B2 | 1/2010 | Akbar et al. | |
| 8,127,856 | B1 | 3/2012 | Nish et al. | |
| 8,657,018 | B2 | 2/2014 | Cravatte | |
| 9,464,496 | B2 * | 10/2016 | O'Rourke | E21B 31/20 |
| 9,765,595 | B2 * | 9/2017 | Themig | E21B 29/00 |
| 2011/0226479 | A1 | 9/2011 | Tippel et al. | |

* cited by examiner

*Primary Examiner* — Catherine Loikith
(74) *Attorney, Agent, or Firm* — Fish & Richardson P.C.

(57) ABSTRACT

A method for operating a circulating sub in a well includes opening a port of the circulating sub, including: dropping a ball into a drill pipe containing a downhole fluid; and seating the ball on an actuator slidably disposed concentrically within the drill pipe, in which seating the ball on the actuator causes motion of the actuator relative to the drill pipe to open a port defined in a wall of the drill pipe. The method includes closing the port of the circulating sub, including: introducing a solvent different from the downhole fluid into the drill pipe, in which a solubility of the ball in the solvent is greater than a solubility of the ball in the downhole fluid; and degrading the ball in the solvent, in which the degrading of the ball causes motion of the actuator relative to the drill pipe to close the port.

17 Claims, 8 Drawing Sheets

DISSOLVABLE BALLS FOR ACTIVATION AND DEACTIVATION OF A CIRCULATING SUB APPARATUS

BACKGROUND

A circulating sub apparatus can be installed in a drill pipe to provide a bypass flow path, e.g., to enable pumping of lost circulation material (LCM) slurry into a well without risk of clogging downhole tools.

SUMMARY

In an aspect, a method for operating a circulating sub in a well includes opening a port of the circulating sub, including: dropping a ball into a drill pipe containing a downhole fluid, in which a port is defined in a wall of the drill pipe; and seating the ball on an actuator slidably disposed concentrically within the drill pipe, in which seating the ball on the actuator causes motion of the actuator relative to the drill pipe to open the port. The method includes closing the port of the circulating sub, including: introducing a solvent different from the downhole fluid into the drill pipe, in which a solubility of the ball in the solvent is greater than a solubility of the ball in the downhole fluid; and degrading the ball in the solvent, in which the degrading of the ball causes motion of the actuator relative to the drill pipe to close the port.

Embodiments can include one or any combination of two or more of the following features.

The ball is insoluble in the downhole fluid.

The ball comprises a core coated with a shell, and in which a solubility of the shell in the solvent is greater than a solubility of the shell in the downhole fluid. A solubility of the shell in the solvent is greater than a solubility of the core in the solvent, and in which the core is insoluble in the downhole fluid. Degrading the ball in the solvent comprises: dissolving or eroding the shell in the solvent; and receiving the core in a ball collector disposed in the drill pipe downhole from the actuator. The method includes retrieving the core. The method includes coating the retrieved core with a new shell for reuse.

Degrading the ball in the solvent comprises completely degrading the ball in the solvent.

The ball comprises a metal. The ball comprises a magnesium based alloy or an aluminum based alloy.

The ball comprises a polymer. The ball comprises polyglycolic acid or polylactic acid.

Introducing the solvent comprises introducing a fluid having an acidity higher than an acidity of the downhole fluid, introducing a fluid having a brine concentration higher than a brine concentration of the downhole fluid, or both.

Seating the ball on the actuator causes the actuator to slide within the drill pipe in a downhole direction to open the port.

Degrading the ball causes the actuator to slide within the drill pipe in an uphole direction to close the port.

16. The method of claim 1, comprising, when the port is open, flowing a lost circulation material slurry through the open port of the circulating sub and into an annular space exterior to the drill pipe.

The method includes, when the port is closed, flowing the downhole fluid through the drill pipe to a bottom hole assembly.

In an aspect, a circulating sub system includes a drill pipe, in which a port is defined in a wall of the drill pipe, and in which the drill pipe contains downhole fluid; an actuator slidably disposed concentrically within the drill pipe; and a ball seated in a seat of the actuator. The ball comprises a core coated with a shell, and in which the shell of the ball is insoluble in the downhole fluid. An outer diameter of the shell is larger than a diameter of a bore of the actuator and a diameter of the core is smaller than the diameter of the bore of the actuator. The actuator with the ball seated therein is disposed downhole of the port defined in the wall of the drill pipe such that a fluid can flow from a bore of the drill pipe, through the port, and into an annular space exterior to the drill pipe. The system also includes a ball collector disposed in the drill pipe downhole from the actuator.

Embodiments can include one or any combination of two or more of the following features.

The core of the ball is insoluble in the downhole fluid.

The ball collector is configured to receive the core of the ball when the shell of the ball is degraded. The actuator is configured to slide within the drill pipe to close the port when the shell of the ball is degraded.

The shell of the ball is soluble in a solvent different from the downhole fluid and in which the core of the ball is insoluble in the solvent. The solvent comprises a fluid having an acidity higher than an acidity of the downhole fluid, a fluid having a brine concentration higher than a brine concentration of the downhole fluid, or both.

The ball comprises a metal. The ball comprises a magnesium based alloy or an aluminum based alloy.

The ball comprises a polymer. The ball comprises polyglycolic acid or polylactic acid.

The approaches described here can have one or more of the following advantages. Actuation of a circulating sub apparatus using a ball that is insoluble in a downhole fluid but soluble in a different solvent provides a well operator control over the timing of the dissolving of the ball; the ball does not dissolve in the downhole fluid, but rather begins dissolving only after the operator has introduced the solvent. Use of a core-shell ball in which the shell is soluble in the solvent and the core is insoluble in the solvent means that balls of a relatively small diameter are collected in a ball collector of the circulating sub apparatus. Thus, more balls can fit in the ball collector before the ball collector needs to be emptied, enabling more activation-deactivation cycles to be performed before interruption of drilling activities. When the entire ball is soluble in the solvent, no ball collector is needed, and an indefinite number of activation-deactivation cycles can be performed without interruption of drilling activities to empty the ball collector.

The details of one or more implementations are set forth in the accompanying drawings and the description below. Other features and advantages will be apparent from the description and drawings, and from the claims.

DETAILED DESCRIPTION

We describe here an approach to activation and deactivation of a circulating sub apparatus in a drill pipe using a ball that is insoluble in a downhole fluid used for well drilling, but soluble in a solvent different from the downhole fluid.

Insertion of the ball into the drill pipe activates the circulating sub apparatus, opening up a bypass flow path that can be used, e.g., for pumping of lost circulation material slurry (LCM). When the solvent is introduced into the drill pipe, the solvent degrades (e.g., dissolves or erodes) the ball, deactivating the circulating sub apparatus and closing the bypass flow path. In some examples, the ball has a uniform composition and is formed of material that is insoluble in the downhole fluid and soluble in the solvent. In these examples, the entirety of the ball is degraded when the solvent is introduced into the drill pipe. In some examples, the ball is a core-shell ball that has a shell formed of a material that is insoluble in the downhole fluid and soluble in the solvent, and an inner core formed of a different material that is insoluble in both the downhole fluid and the solvent. In these examples, the shell of the ball is degraded when the solvent is introduced into the drill pipe, and the core remains intact and is collected in a ball collector of the circulating sub apparatus.

Figure 1B:
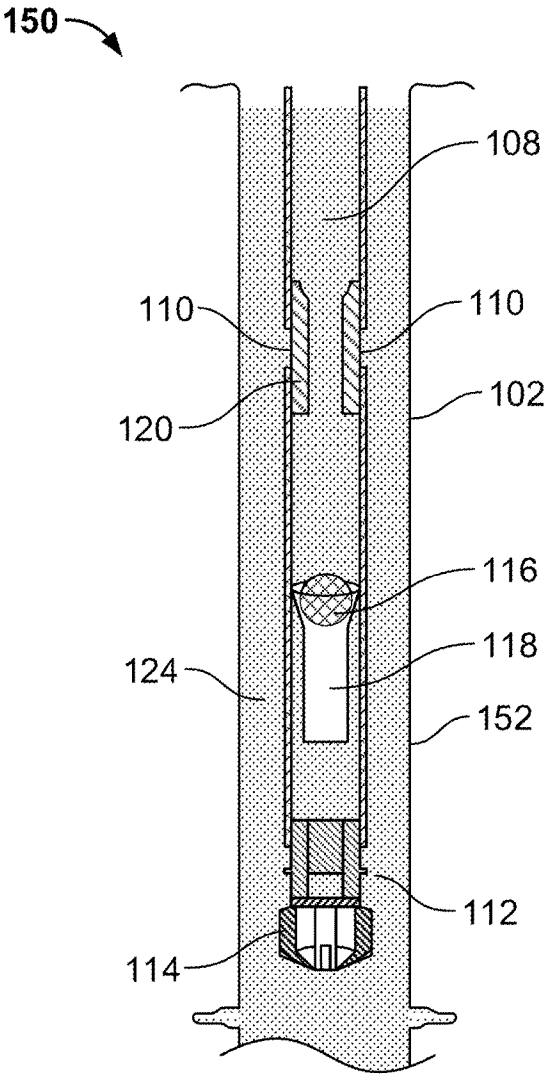
FIGS. 1A and 1B are diagrams of a circulating sub apparatus.
Figure 1A:
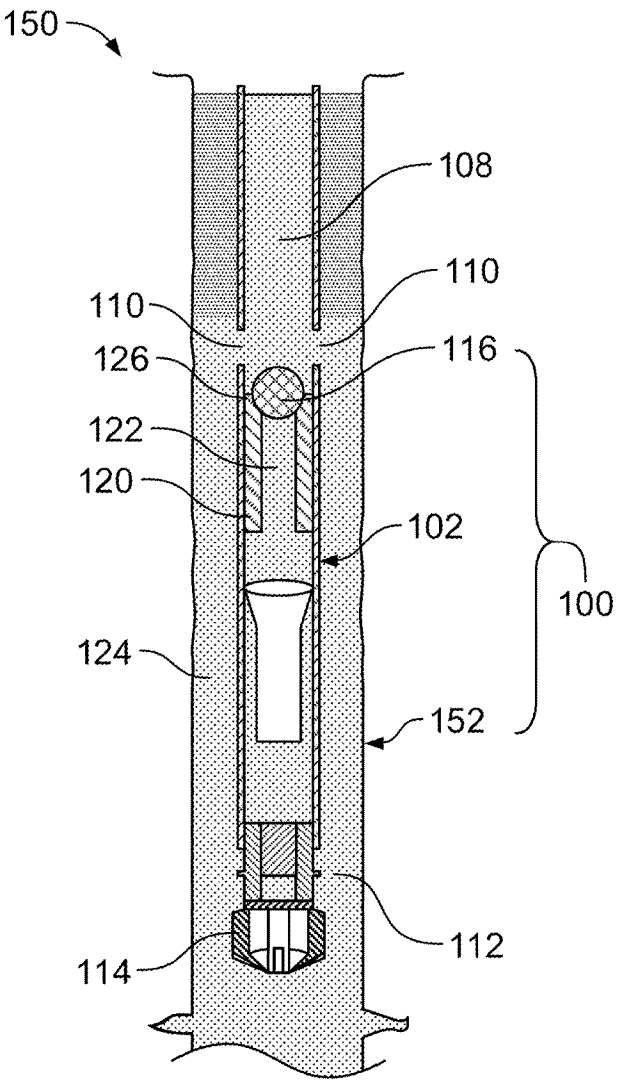

FIGS. 1A and 1B show a drillstring assembly 150 disposed in a wellbore 152. A drill pipe 102 is positioned in the wellbore 152. A bottom end of the drill pipe 102 is coupled to a bottom hole assembly 112 including a drill bit 114. A circulating sub 100 is a downhole sub disposed in the drill pipe 102. Activation of the circulating sub 100 opens ports 110 in the drill pipe 102; deactivation of the circulating sub 100 closes the ports 110. The ports 110 are defined through the wall of the drill pipe 102 and provide a fluid pathway between an annular space 124 in the wellbore 152 exterior to the drill pipe 102 and an inner bore 108 of the drill pipe 102.

The circulating sub 100 includes an actuator 120 disposed within the inner bore 108 of the drill pipe 102. The actuator 120 is a generally cylindrical tube that is concentric with the drill pipe 102. An inner bore 122 of the actuator 120 has a smaller diameter than the diameter of the inner bore 108 of the drill pipe 102. The actuator 120 is configured to slide within the drill pipe 102. The actuator 120 can slide upwards (toward the top end 106 of the circulating sub 100) to a deactivated position and downwards (toward the bottom end 104 of the circulating sub 100) to an activated position. When the actuator 120 is in the deactivated position (FIG. 1A), the actuator 120 blocks the ports 110, preventing fluid flow between the annular space 124 exterior to the drill pipe 102 and the inner bore 108. When the actuator 120 is in the activated position (FIG. 1B), the ports 110 are opened, and fluid can flow between the annular space 124 exterior to the drill pipe 102 and the inner bore 108. In some examples, the circulating sub 100 is a PBL sub.

A circulating sub apparatus can be useful for managing lost circulating material (LCM) slurry containing particulates, fibrous materials, or a combination thereof. Lost circulation can be encountered when drilling through fractured or vugular formations. In some cases, lost circulation is mitigated by pumping LCM slurry. However, the particulates or fibrous materials in the LCM slurry can clog tools of the bottom hole assembly (BHA), such as a mud motor, measurement while drilling (MWD) tools, logging while drilling (LWD) tools, or other downhole tools. With a circulating sub apparatus assembled with a BHA, fluid flow can be switched from the interior of the drill column (e.g., the inner bore 108 of FIGS. 1A and 1B) to the annular space 124 exterior to the drill pipe 102. When the circulating sub 100 is activated, fluid (e.g., LCM slurry) flows down the drill pipe 102 only to the level of the ports 110, from where the LCM fluid exits the drill pipe 102 and flows through the annular space 124 and into fractures or vugular formations. The BHA elements located below (e.g., downhole from) the circulating sub 100 are bypassed by the LCM slurry. When circulation is regained, the circulating sub 100 is deactivated, and normal fluid circulation through the drill pipe 102 and to the BHA 112 resumes. In this way, LCM slurry can be pumped, bypassing the BHA 112, without having to remove the BHA 112. This approach enables loss of circulation to be mitigated in a timely fashion.

As discussed in more detail in the following paragraphs, the circulating sub 100 is activated by dropping a ball 116 into the inner bore 108 of the drill pipe 102. The ball 116 rests on a seat 126 defined at a top of the actuator 120, where the weight of the ball causes the actuator 120 to slide downwards into the activated position, thereby opening the ports 110. When the ball 116 is removed from the seat 126 of the actuator 120, the actuator 120 slides upwards into the deactivated position, thereby closing the ports 110. In the example of FIGS. 1A and 1B, the ball 116 is removed from the seat 126 of the actuator 120 and received by a ball catcher 118 positioned downhole from the actuator 120 in the inner bore 108 of the drill pipe 102. We describe here approaches to deactivate the circulating sub 100 by partially or entirely dissolving the ball 116.

Referring briefly to FIGS. 2A-2E, in an example operation of the drillstring assembly 150, the actuator 120 of the circulating sub 100 is actuated by a ball 200 that has a core coated with a shell material; the ball 200 is thus sometimes referred to as a core-shell ball. We use the term ball generally to refer to an object that, regardless of its orientation, is sized to fit within the inner bore 108 of the drill pipe 102 of the circulating sub 100. A ball within the scope of this disclosure is not necessarily spherical.

The shell material of the core-shell ball 200 is insoluble (e.g., resistant to degradation by dissolving or eroding) a downhole fluid 202, such as a drilling fluid, that is present in and around the circulating sub 100, e.g., in the inner bore 108 and in the annular space 124 exterior to the circulating sub 100. When the core-shell ball 200 is seated on the actuator 120, the circulating sub 100 is activated and the ports 110 are open. To close the ports 110, a solvent capable of degrading (e.g., dissolving or eroding) the shell of the core-shell ball is pumped into the circulating sub 100. The shell of the ball dissolves or erodes, leaving the core, which is small enough to pass through the inner bore 122 of the actuator 120, thereby freeing the actuator to slide upwards and deactivate the circulating sub 100.

Use of a solvent that is different from the downhole fluid to degrade the ball provides a well operator with control over the timing of deactivation of the circulating sub apparatus 100. Degradation of the ball begins only once the operator introduces the solvent into the drill pipe 102.

Figure 3B:
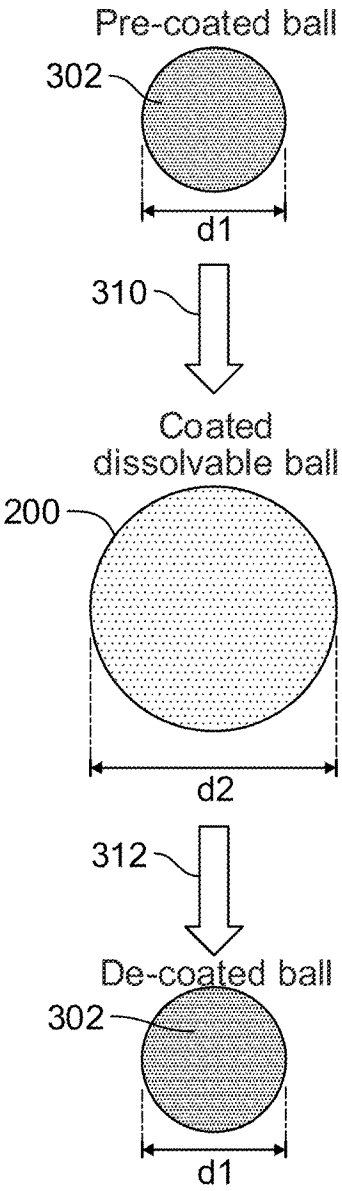
FIGS. 3A and 3B are diagrams of a core-shell ball.
Figure 3A:
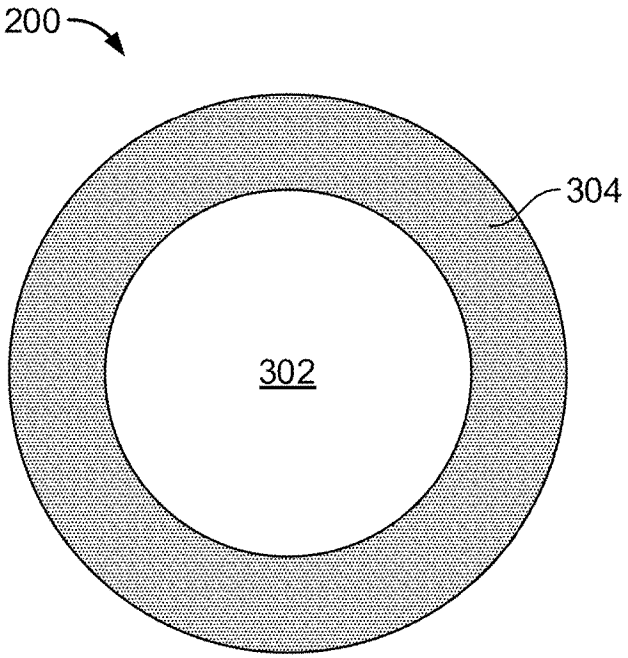

FIG. 3A shows a cross-section of the core-shell ball 200. A core 302 is coated with a shell 304 of a different material. A diameter d1 of the core 302 is smaller than a diameter d2 of the coated ball 200 (including the core 302 coated with the shell 304). Referring also to FIG. 3B, the core-shell ball 200 is fabricated by coating the core 302 with a shell material (discussed in more detail infra), a transformation represented by an arrow 310. Accordingly, the diameter d2 of the core-shell ball 200 is larger than the diameter d1 of the core 302 alone. When used in a circulating sub, when the shell degrades (a transformation represented by an arrow 312), the smaller-diameter core 302 remains.

Referring again to FIGS. 2A-2E, and specifically to FIG. 2A, the core-shell ball 200 is dropped into the inner bore 108 of the drill pipe 102, and travels downwards through the downhole fluid 202 in the inner bore 108 to the seat 126 of the actuator 120. The diameter d2 of the core-shell ball 200 is sized to fit within the inner bore 108 of the drill pipe 102 but not within the inner bore 122 of the actuator 120. Thus, referring also to FIG. 2B, the ball 200 comes to rest on the seat 126 of the actuator 120. The weight of the ball on the seat 126 of the actuator 120 causes the actuator 120 to slide downwards relative to the drill pipe 102, opening the ports 110 and activating the circulating sub 100.

In the example of FIGS. 2A-2E, when the circulating sub 100 is activated, lost circulation material (LCM) slurry 208 containing particulate and fibrous materials is pumped into the drill pipe 102, through the ports 110 and into the annular space 124 exterior to the drill pipe 102, and into fractures or vugular formations to mitigate lost circulation.

Figure 2C:
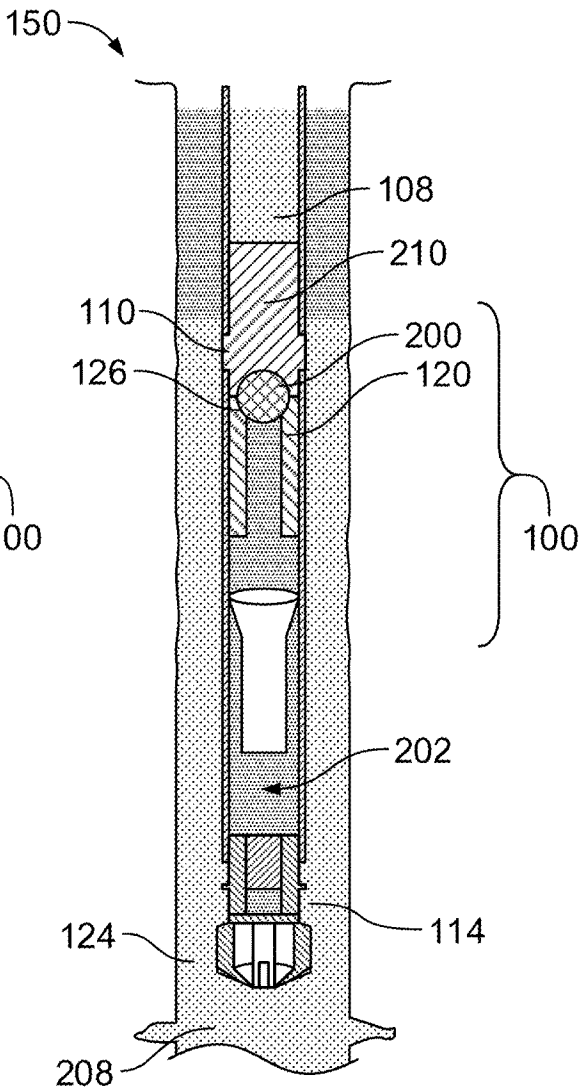
FIGS. 2A-2E are diagrams of a circulating sub apparatus.
Figure 2B:
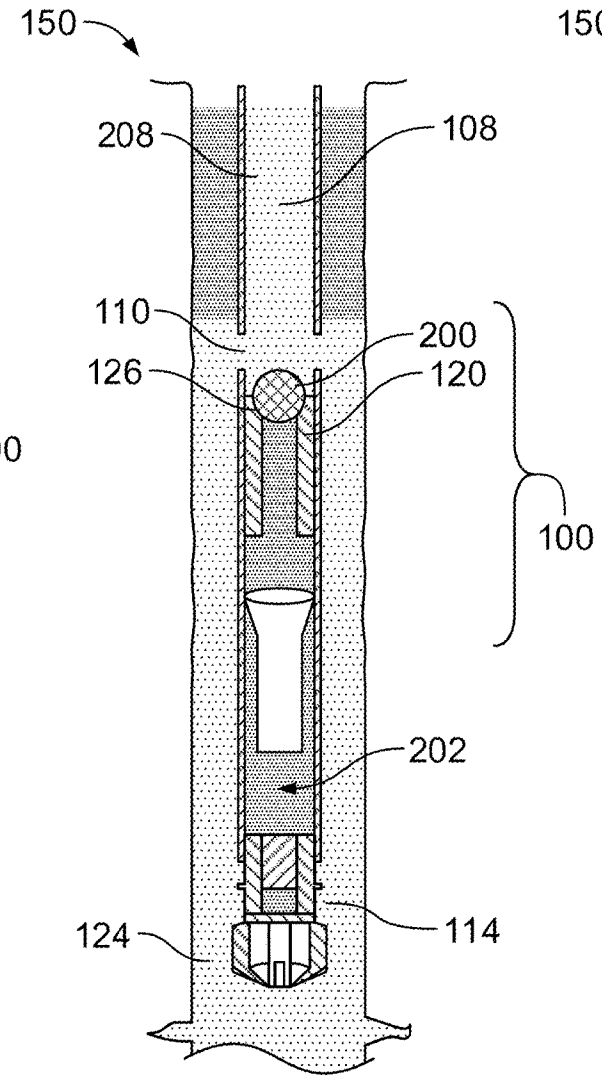
Figure 2A:
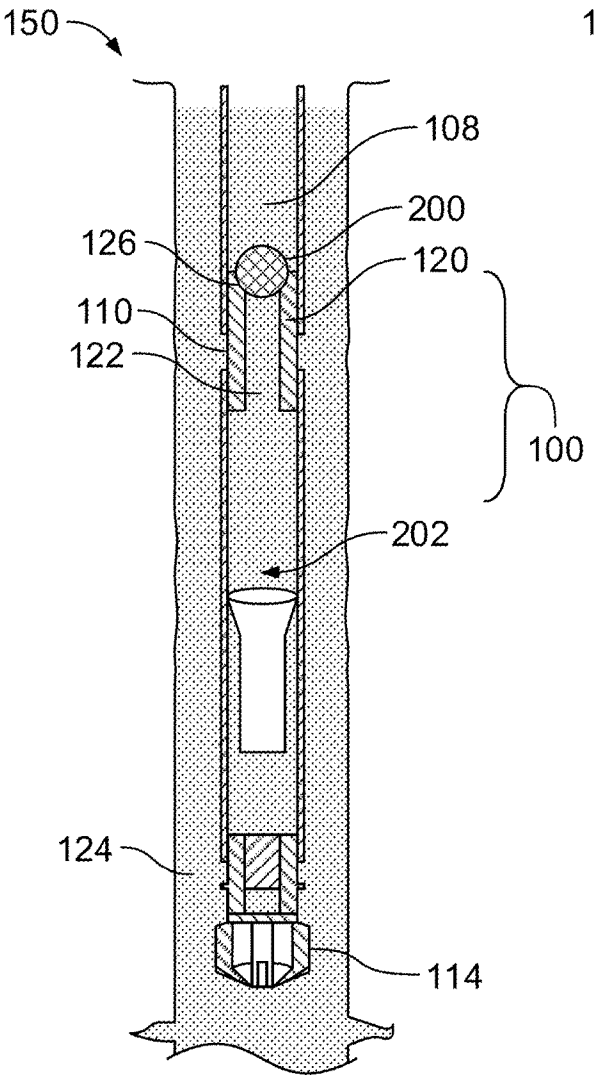

Referring to FIG. 2C, after circulation is regained, a solvent 210 is pumped into the inner bore 108 of the drill pipe 102. The solvent 210 is different from the downhole fluid 202. In some examples, the solubility of the core-shell ball 200 in the solvent 210 is different from the solubility of the core-shell ball 200 in the downhole fluid 202. Solubility of the ball here refers generally to the tendency of the ball to degrade (e.g., dissolve or erode) in a fluid. Specifically, the solubility of the shell of the core-shell ball 200 in the solvent 210 is greater than the solubility of the shell in the downhole fluid 202, e.g., the shell of the core-shell ball 200 is soluble (e.g., capable of degrading by dissolving or eroding) in the solvent 210 but insoluble in the downhole fluid 202. The core of the core-shell ball 200 is less soluble than the shell of the core-shell ball 200 (e.g., insoluble) in both the solvent 210 and the downhole fluid 202.

Figure 2E:
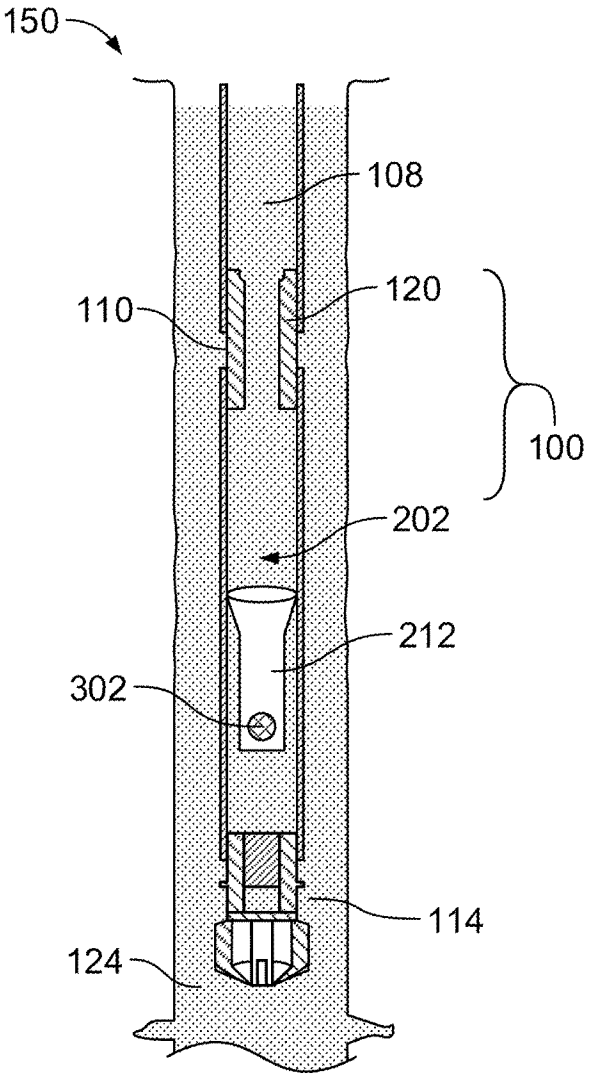
Figure 2D:
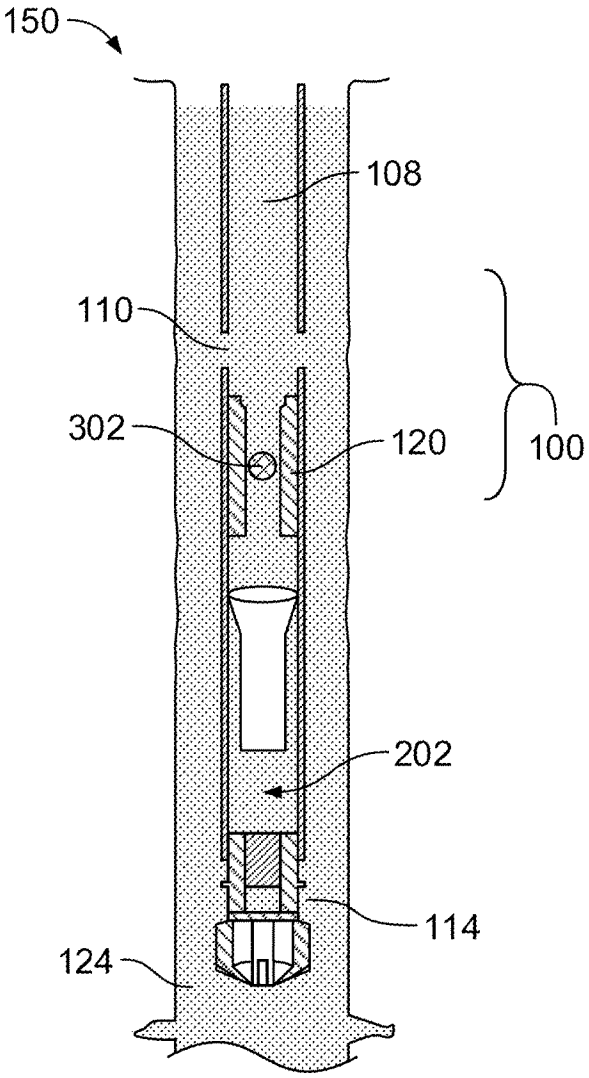

Referring to FIG. 2D, the presence of the solvent 210 degrades (e.g., erodes or dissolves) the shell of the core-shell ball 200, such that only the core 302 of the ball remains. In some examples, the shell is degraded by dissolving, erosion, or a combination thereof, to generate a powder that is flushed away by dynamic flow of downhole fluid once the circulating sub is deactivated. In some examples, the shell is dissolved by the solvent 210, leaving ions that are fully dissolved in the solvent 210. The core 302 of the ball has a smaller diameter d1 than the diameter d2 of the core-shell ball 200 itself, and thus the core 302 can fit within the inner bore 122 of the actuator 120. Referring also to FIG. 2E, the core 302 thus passes through the inner bore 122 of the actuator 120 and is collected in a ball catcher 212. The actuator 120 slides upwards within the drill pipe 102, deactivating the circulating sub 100 and closing the ports 110. Normal circulation of the downhole fluid 202 through the drill pipe 102 and to the BHA 112 resumes.

By activating and deactivating the circulating sub 100 using the core-shell ball 200, only a single ball is used for each round of activation and deactivation; no additional balls are used to deactivate the sub. In addition, the diameter of the ball 200 can be smaller than balls used in other approaches to activation and deactivation of circulating subs, meaning that the ball catcher 212 can hold more balls 200. For instance, in some examples the circulating sub 100 can be used for more than five rounds of activation and deactivation before the ball catcher 212 becomes full.

The shell 304 of the core-shell ball 200 is formed from a material that is more soluble in the solvent 210 than in the downhole fluid 202. In some examples, the shell 304 is formed of a metal-based material, such as a magnesium based alloy or an aluminum based alloy. The solvent 210 can be an acid (e.g., a fluid with a higher acidity than that of the downhole fluid 202) or a brine (e.g., a fluid with a higher brine concentration than that of the downhole fluid 202). With an acid as the solvent, the shell of the ball dissolves into ions fully dissolved in the solvent. With a brine as the solvent, the shell of the ball breaks down into a metal hydroxide powder, which has low solubility in brine.

The rate of degradation (e.g., erosion or dissolution) a metal alloy, such as a magnesium based alloy or an aluminum based alloy, depends on parameters such as downhole temperature and downhole pressure, and on the composition of the solvent 210. In some examples, the composition of the metal alloy of the shell 304 of the core-shell ball 200 is selected to achieve a desired rate of degradation, given an expected downhole temperature and pressure and given a particular composition of the solvent 210. In some examples, an operator selects an solvent 210 to use to achieve a desired rate of degradation given a particular composition of the shell and an actual downhole temperature and pressure. For instance, the operator can select the solvent 210 to expedite or delay the degradation of the shell of the ball 200, e.g., the operator can select a concentration or brine, with higher concentrations generally causing a faster rate of degradation.

In some examples, the shell 304 of the core-shell ball 200 is formed of a polymer, such as polyglycolic acid (PGA) or polylactic acid (PLA). Polymers are degraded by hydrolysis, in which the long polymer chains are broken down into smaller polymers or monomers when exposed to water or humidity, thereby losing structural integrity and mechanical properties. Over time, or as temperature increases, the smaller-chain polymers or monomers become acids, after which no solid shell remains. For instance, PGA degrades into glycolic acid, and PLA degrades into lactic acid. The dissolving or degrading rate of the polymer shell depends mainly on the temperature and on the composition of the solvent 210.

Figure 4:
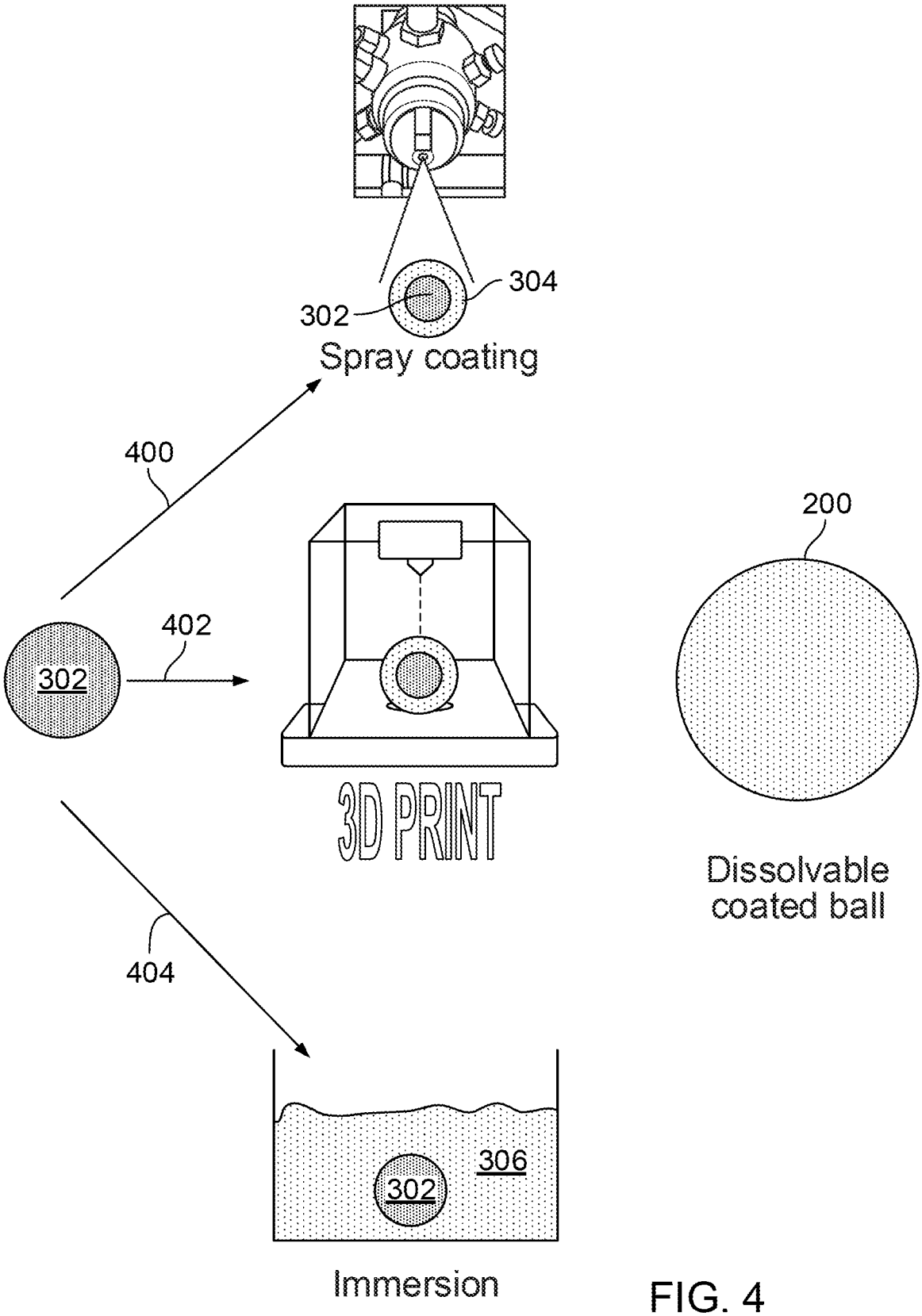
FIG. 4 is a diagram of manufacturing processes.

Referring to FIG. 4, various approaches can be used to coat the core 302 with the shell 304 to form the core-shell ball 200. In some examples, the shell 304 is spray coated onto the core 302 (400). In some examples, the shell 304 is formed by additive manufacturing (e.g., three-dimensional (3D) printing) the material of the shell 304 onto the core 302 (402). In some examples, the shell 304 is formed by immersing the core 302 into a solution 306 of the material of the shell (404). Upon drying, the material remains on the core 302, forming the shell 304. In some examples, the core 302 can be reused. For instance, one or more cores 302 can be recovered from the ball catcher 212, cleaned, and coated with a new shell 304 for reuse in the circulating sub.

Referring to FIGS. 5A-5E, in an example, the actuator 120 of the circulating sub 100 is actuated by a ball 500 of uniform composition throughout its diameter. The ball is insoluble in the downhole fluid 202 and soluble in a solvent 510. When the ball 500 is seated on the actuator 120, the circulating sub 100 is activated and the ports 110 are open. To close the ports 110, the solvent 510 is pumped into the circulating sub 100. The ball dissolves, freeing the actuator 120 to slide upwards and deactivate the circulating sub 100.

Figure 5C:
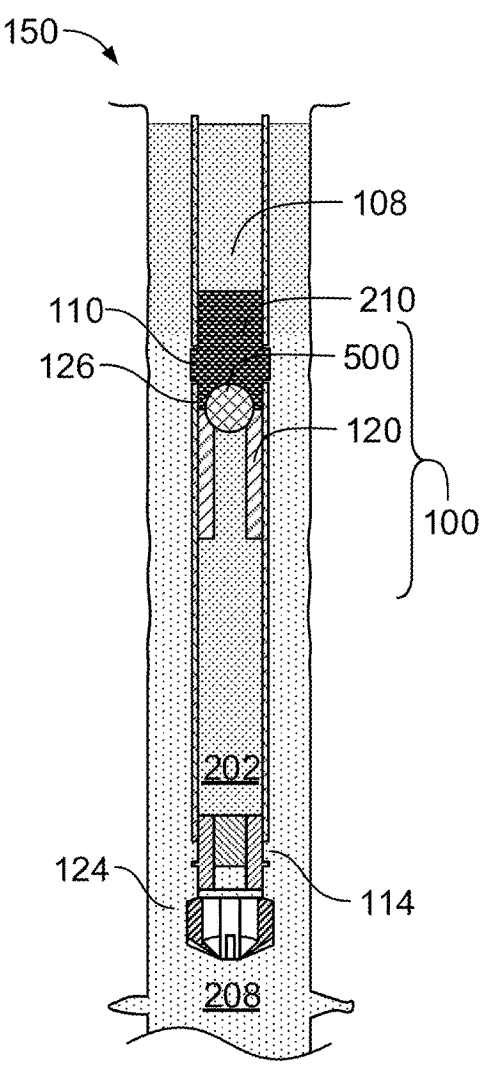
FIGS. 5A-5E are diagrams of a circulating sub apparatus.
Figure 5B:
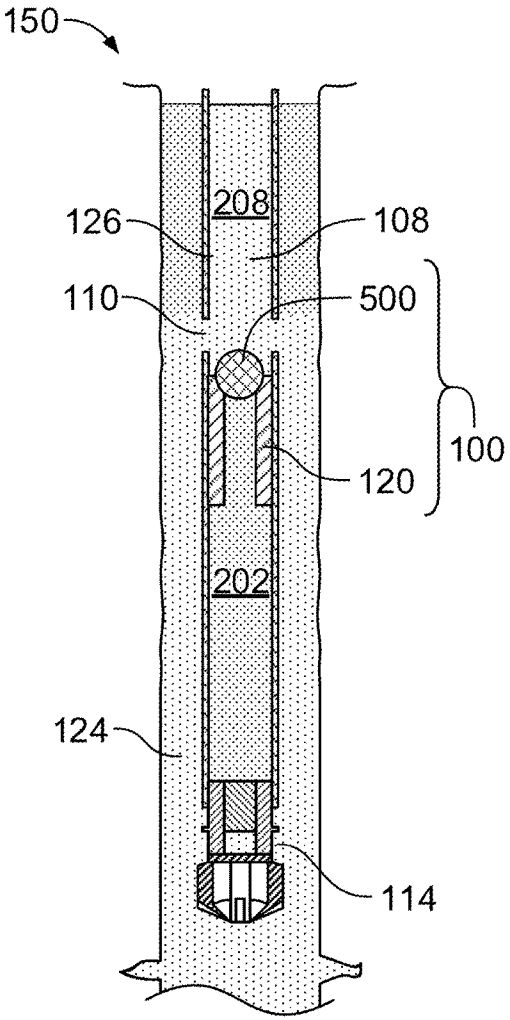
Figure 5A:
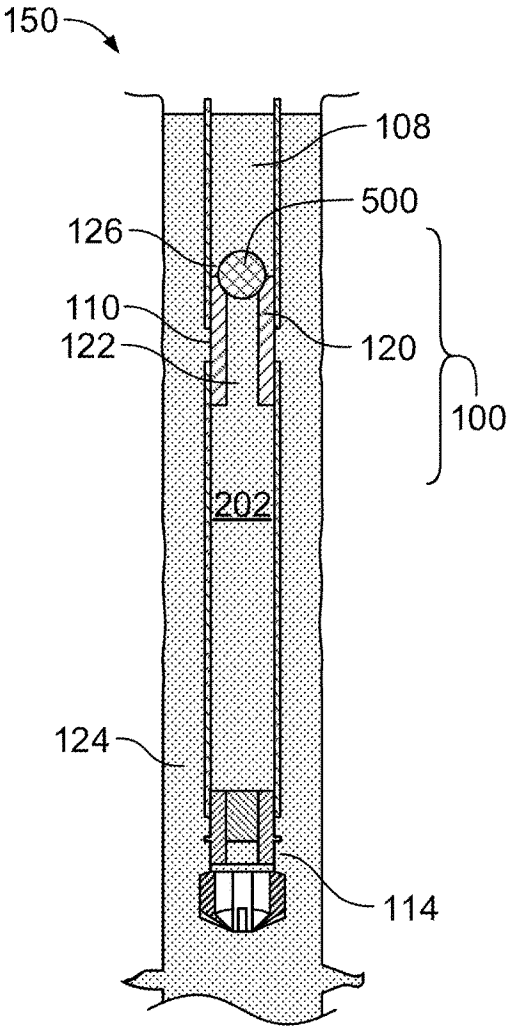

Referring specifically to FIG. 5A, the ball 500 is dropped into the inner bore 108 of the drill pipe 102, and travels downwards through the downhole fluid 202 in the inner bore 108 to the seat 126 of the actuator 120. The diameter of the ball 500 is sized to fit within the inner bore 108 of the drill pipe 102 but not within the inner bore 122 of the actuator 120. Thus, referring also to FIG. 5B, the ball 500 comes to rest on the seat 126 of the actuator 120. The weight of the ball 500 on the seat 126 of the actuator 120 causes the actuator 120 to slide downwards relative to the drill pipe 102, opening the ports 110 and activating the circulating sub 100. In the example of FIGS. 5A-5E, when the circulating sub 100 is activated, LCM slurry 208 is pumped into the drill pipe 102, through the ports 110 and into the annular space 124 exterior to the drill pipe, and into fractures or vugular formations to mitigate lost circulation.

Referring to FIG. 5C, after circulation is regained, the solvent 510 is pumped into the inner bore 108 of the drill pipe 102. In some examples, the solubility of the ball 500 in the solvent 510 is greater than the solubility of the ball 500 in the downhole fluid 202, e.g., the ball 500 is soluble in the solvent 510 but insoluble in the downhole fluid 202.

Figure 5E:
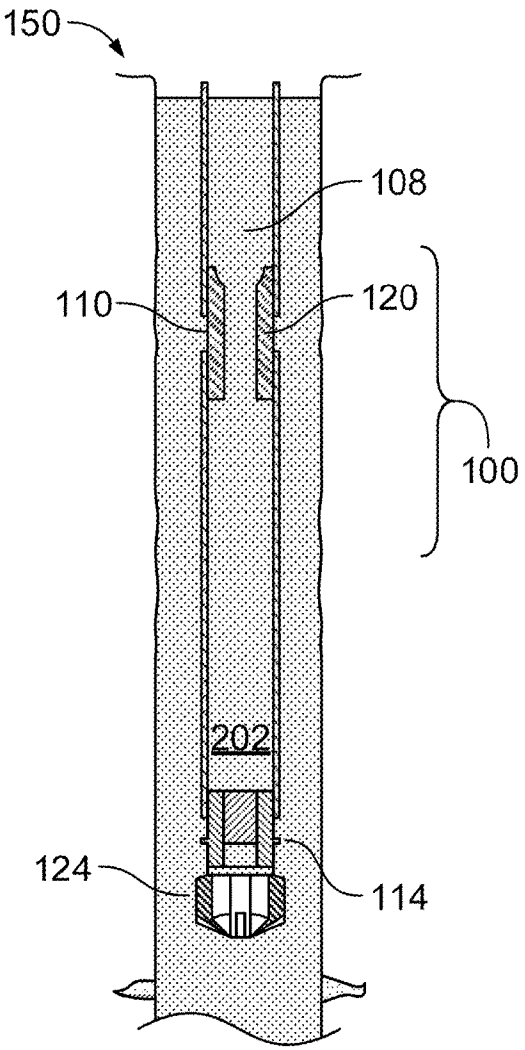
Figure 5D:
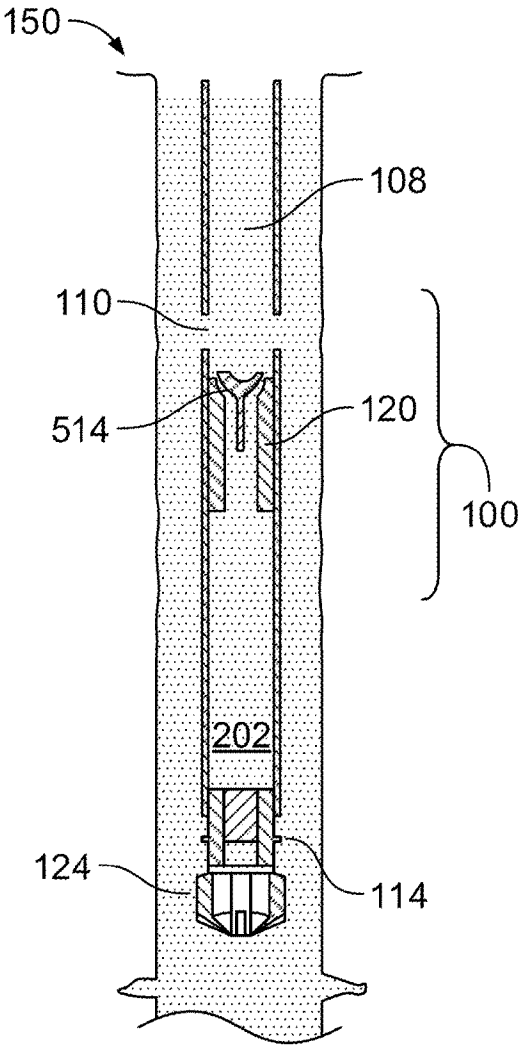

Referring to FIG. 5D, the presence of the solvent 510 completely degrades (e.g., erodes or dissolves) the ball 500. In the example of FIG. 5D, the ball 500 is eroded by the solvent 210, leaving a powder 514 that is flushed away by dynamic flow of downhole fluid once the circulating sub is deactivated. In some examples, the ball 500 is dissolved by the solvent 210, leaving ions that are fully dissolved in the solvent 510. Complete degradation of the ball 500 encompasses degradation of the ball 500 such that small pieces of ball material remain that are small enough to pass through the inner bore 122 of the actuator 120 and that do not impede functioning of the well. Referring to FIG. 5E, when the ball 500 is degraded, the actuator 120 slides upwards within the drill pipe 102, deactivating the circulating sub 100 and closing the ports 110. Normal circulation of downhole fluid 202 resumes.

In the approach of FIGS. 5A-5E, no ball collector is used with the circulating sub 100 because the entirety of the ball 500 is degraded, e.g., dissolves or is eroded. This means that the circulating sub 100 can be activated and deactivated any number of times without the need to empty a ball catcher.

In some examples, the ball 500 is formed of a metal-based material, such as a magnesium based alloy or an aluminum based alloy and the solvent can be an acid or a brine. With an acid as the solvent, the shell of the ball dissolves into ions fully dissolved in the solvent. With a brine as the solvent, the shell of the ball breaks down into a metal hydroxide powder (e.g., the powder 514 of FIG. 5D), which has low solubility in brine. The rate of degradation of the ball 500 can be controlled by selecting the composition of the ball 500, the composition of the solvent 510, or both, as described supra for FIGS. 2A-2E. In some examples, the ball 500 is formed of a polymer, such as PGA or PLA, as described supra.

Figure 6:
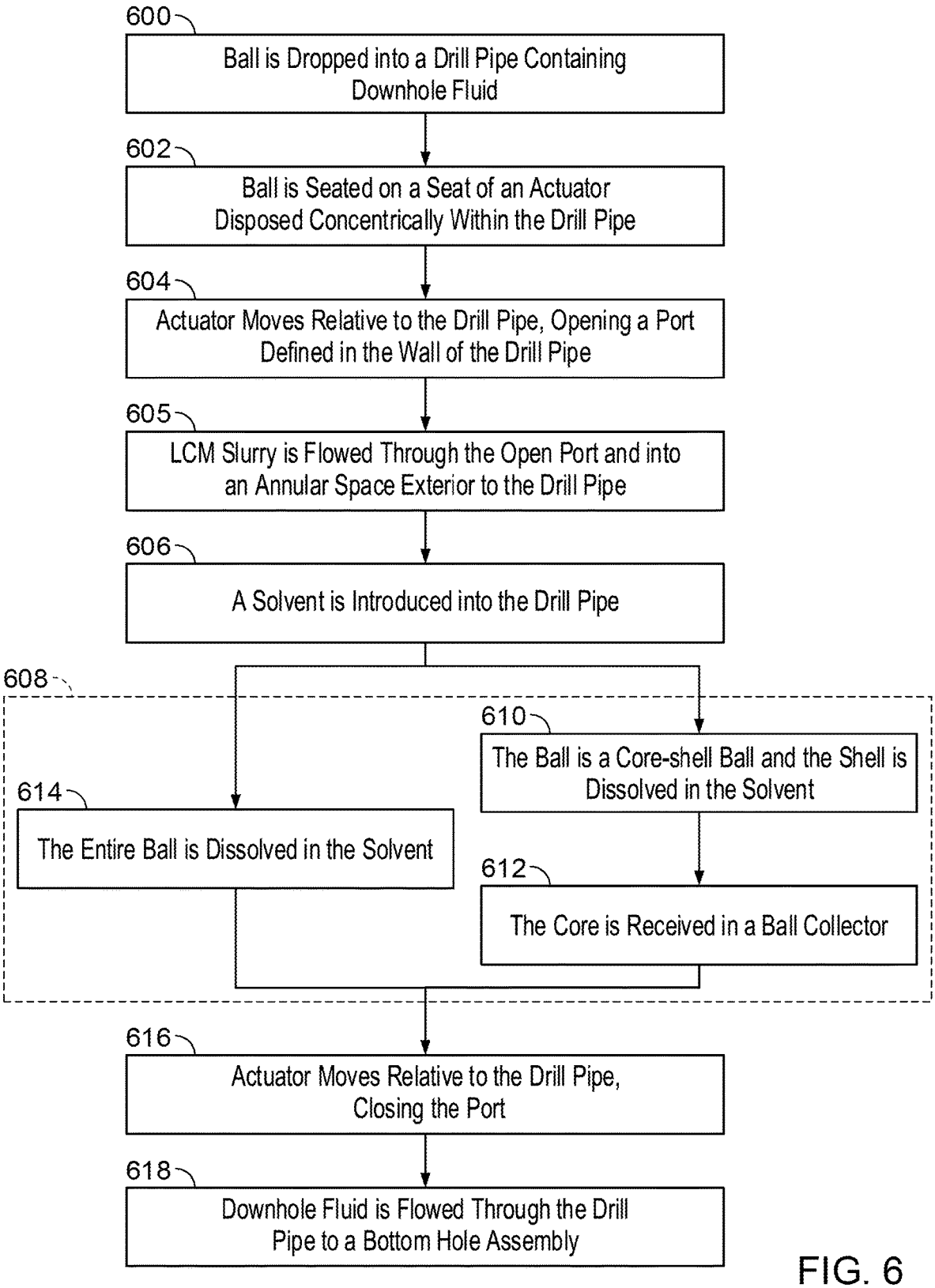
FIG. 6 is a flow chart.

Referring to FIG. 6, in an example method for operating a circulating sub in a well, a ball is dropped into a drill pipe containing a downhole fluid (600). A port is defined in a wall of the drill pipe. The ball is seated on a seat of an actuator that is slidably disposed concentrically within the drill pipe (602). The seating of the ball on the actuator causes motion of the actuator in the downhole direction relative to the drill pipe, thereby opening the port (604).

A lost circulation material slurry is flowed through the open port and into an annular space exterior to the drill pipe (605).

A solvent that is different from the downhole fluid is introduced into the drill pipe (606). A solubility of the ball in the solvent is greater than a solubility of the ball in the downhole fluid. In some examples, the ball includes a core coated with a shell, and a solubility of the shell in the solvent is greater than a solubility of the shell in the downhole fluid, and a solubility of the shell in the solvent is greater than a solubility of the core in the solvent, and the core is insoluble in the downhole fluid. In some examples, the solubility of the entire ball in the solvent is greater than the solubility of the entire ball in the downhole fluid.

The ball is degraded (e.g., dissolved or eroded) in the solvent (608). When the ball is a core-shell ball, degrading the ball includes degrading the shell in the solvent (610) and receiving the core in a ball collector disposed in the drill pipe downhole from the actuator (612). When the ball is formed of a uniform composition, the ball is completely degraded in the solvent (614).

Degrading the ball the ball causes motion of the actuator in the uphole direction relative to the drill pipe to close the port (616) and the downhole fluid is flowed through the drill pipe to a bottom hole assembly (618).

Particular embodiments of the subject matter have been described. Other embodiments are within the scope of the following claims.

What is claimed is:

1. A method for mitigating lost circulation while drilling a well, the method comprising:

opening a port of a circulating sub, including:

dropping a ball into a drill pipe containing a downhole fluid, in which the port is defined in a wall of the drill pipe; and seating the ball on an actuator slidably disposed concentrically within the drill pipe, in which seating the ball on the actuator causes motion of the actuator relative to the drill pipe to open the port; establishing circulation by pumping a lost circulation material slurry through the drill pipe, out of the port, and into an annulus of a wellbore exterior to the drill pipe, bypassing a bottom hole assembly comprising a drill bit;

in response to establishing circulation, closing the port of the circulating sub, including:

introducing a solvent different from the downhole fluid and the lost circulation material slurry into the drill pipe, in which a solubility of the ball in the solvent is greater than a solubility of the ball in the downhole fluid and the lost circulation material slurry; and degrading the ball in the solvent, in which the degrading of the ball deactivates the circulating sub causing the port to close.

2. The method of claim 1, in which the ball is insoluble in the downhole fluid.

3. The method of claim 1, in which the ball comprises a core coated with a shell, and in which a solubility of the shell in the solvent is greater than a solubility of the shell in the downhole fluid.

4. The method of claim 3, in which the solubility of the shell in the solvent is greater than a solubility of the core in the solvent, and in which the core is insoluble in the downhole fluid.

5. The method of claim 3, in which degrading the ball in the solvent comprises:

dissolving or eroding the shell in the solvent; and receiving the core in a ball collector disposed in the drill pipe downhole from the actuator.

6. The method of claim 5, comprising retrieving the core.

7. The method of claim 6, comprising coating the retrieved core with a new shell for reuse.

8. The method of claim 1, in which degrading the ball in the solvent comprises completely degrading the ball in the solvent.

9. The method of claim 1, in which the ball comprises a metal.

10. The method of claim 9, in which the ball comprises a magnesium based alloy or an aluminum based alloy.

11. The method of claim 1, in which the ball comprises a polymer.

12. The method of claim 11, in which the ball comprises polyglycolic acid or polylactic acid.

13. The method of claim 1, in which introducing the solvent comprises introducing a fluid having an acidity higher than an acidity of the downhole fluid, introducing a fluid having a brine concentration higher than a brine concentration of the downhole fluid, or both.

14. The method of claim 1, in which seating the ball on the actuator causes the actuator to slide within the drill pipe in a downhole direction to open the port.

15. The method of claim 1, in which degrading the ball causes the circulating sub to deactivate causing the actuator to slide within the drill pipe in an uphole direction to close the port.

16. The method of claim 1, comprising, when the port is open, flowing a lost circulation material slurry through the open port of the circulating sub and into an annular space exterior to the drill pipe.

17. The method of claim 1, comprising, when the port is closed, flowing the downhole fluid through the drill pipe to a bottom hole assembly.

* * * * *